United States Patent [19]

Thomas

[11] 4,248,256

[45] Feb. 3, 1981

[54] PLATFORM CRUTCH ATTACHMENT FOR AN INVALID WALKER

[75] Inventor: Morton I. Thomas, Nyack, N.Y.

[73] Assignee: Temco Products, Inc., Passaic, N.J.

[21] Appl. No.: 72,012

[22] Filed: Sep. 4, 1979

[51] Int. Cl.[3] ..... A61H 3/00; A61H 3/02

[52] U.S. Cl. ..... 135/67; 135/71

[58] Field of Search ..... 135/67, 66, 65, 68, 135/71, 73; 297/5, 6

[56] References Cited

U.S. PATENT DOCUMENTS

| | | | |
|---|---|---|---|
| 2,759,525 | 8/1956 | Ries | 135/67 |
| 2,796,916 | 6/1957 | Womble | 135/67 |
| 3,625,237 | 12/1971 | Wertz | 135/67 |

FOREIGN PATENT DOCUMENTS

| | | | |
|---|---|---|---|
| 2255881 | 7/1975 | France | 135/67 |
| 345114 | 4/1960 | Switzerland | 135/67 |
| 663247 | 12/1951 | United Kingdom | 135/71 |
| 847873 | 9/1960 | United Kingdom | 135/67 |

*Primary Examiner*—J. Karl Bell

*Attorney, Agent, or Firm*—Richard C. Woodbridge

[57] ABSTRACT

A platform crutch attachment having a wide selection of adjustments may be attached to a conventional invalid walker. The handle can be tilted, moved backwards or forwards, or rotated sideways and then securely locked to provide the user with the optimum grip position. A comfortable break-away cuff is located near the handle and positioned so that it is directly above the attaching points to the invalid walker. Upper and lower mounting brackets connect the shaft of the platform crutch to the upper and lower brace of the invalid walker respectively. The upper mounting bracket includes a bite plate having teeth which securely dig into the shaft of the crutch. The platform crutch can be mounted on either the left or right side of the invalid walker and adjusted so that the user obtains maximum comfort and security from the combination.

13 Claims, 15 Drawing Figures

PLATFORM CRUTCH ATTACHMENT FOR AN INVALID WALKER

BACKGROUND OF THE INVENTION

1. Field of the Invention

This invention relates in general to the crutch art and in particular to a specific platform crutch which may be attached to a conventional invalid walker.

2. Description of the Prior Art

There are instances where a forearm attachment or the like is connected to an invalid walker. One device is described on page 10 of a catalog copyrighted in 1977 and entitled "Lumex-Medical Equipment and Patient Aids". The catalog is distributed by Lumex, Inc., 100 Spence St., Bay Shore, New York, 11706. The crutch is described as a Model 6130 or Model 6023.

Another prior art platform crutch attachment is sold by Guardian Products, Inc. of North Hollywood, Fla. That Model, Stock No. 7702, is described on page 61 of the Guardian Catalog dated 1971.

SUMMARY OF THE INVENTION

Briefly described the invention comprises an improved platform crutch attachment for use on a conventional invalid walker. The handle of the crutch may be adjusted to accomodate a wide variety of grip positions. A reversible cuff includes a gap therein so that the user may disengage from the crutch in an emergency. The shaft of the crutch comprises a pair of telescoping tubes which are connected to the horizontal braces of the walker by upper and lower mounting brackets respectively. The upper bracket includes a bite plate which firmly grabs the shaft and prevents it from rotating. The shaft is secured in position on the walker so that the weight of the cuff is located directly over the upper and lower mounting brackets. The platform crutch is unique in its total adjustability, safety and reversibility when compared to prior art devices.

DETAILED DESCRIPTION OF THE INVENTION

During the course of this description like numbers will be used to identify like elements according to the different figures which illustrate the invention.

Figure 1:
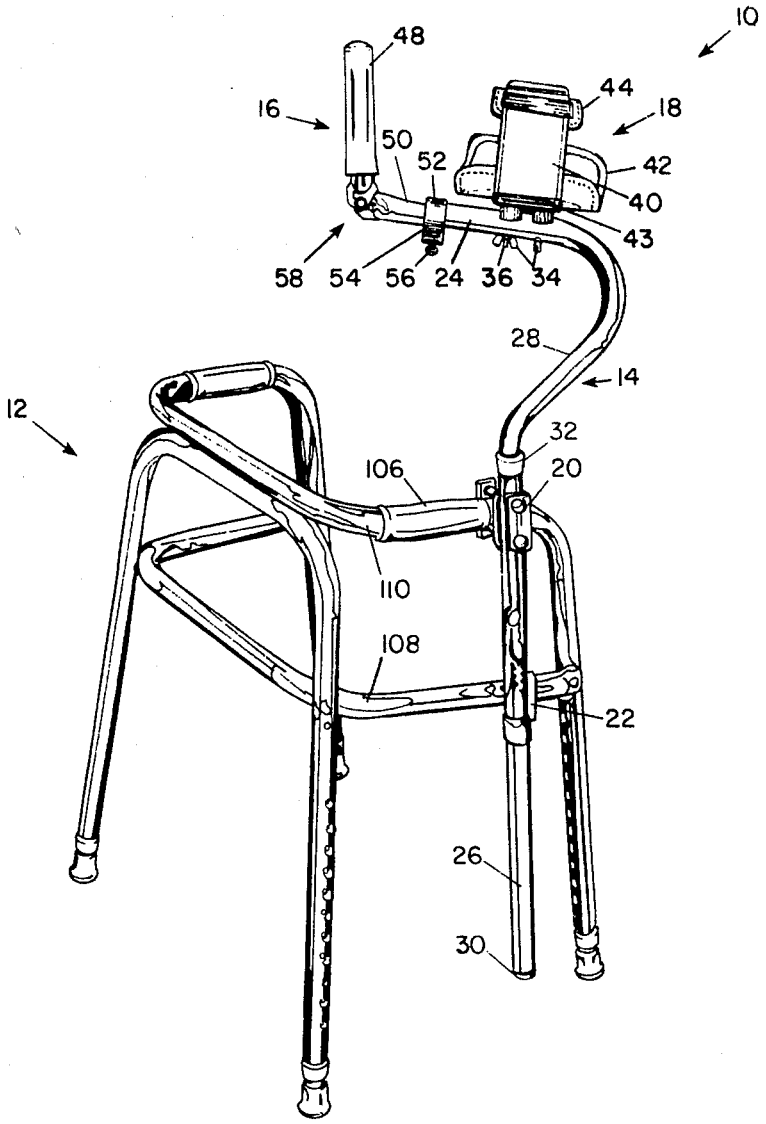
FIG. 1 is a perspective view of the preferred embodiment of the invention mounted on a conventional invalid walker.
Figure 3:
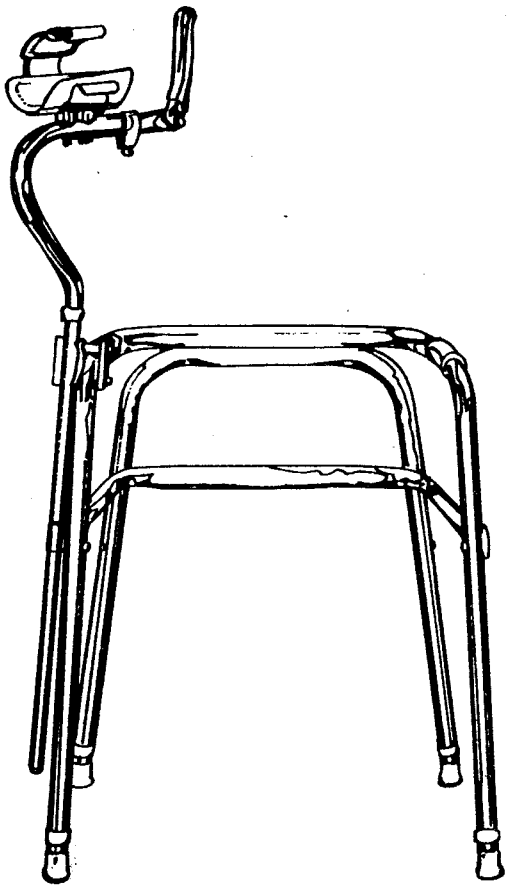
FIG. 3 is a rear view of the embodiment of FIG. 1.
Figure 2:
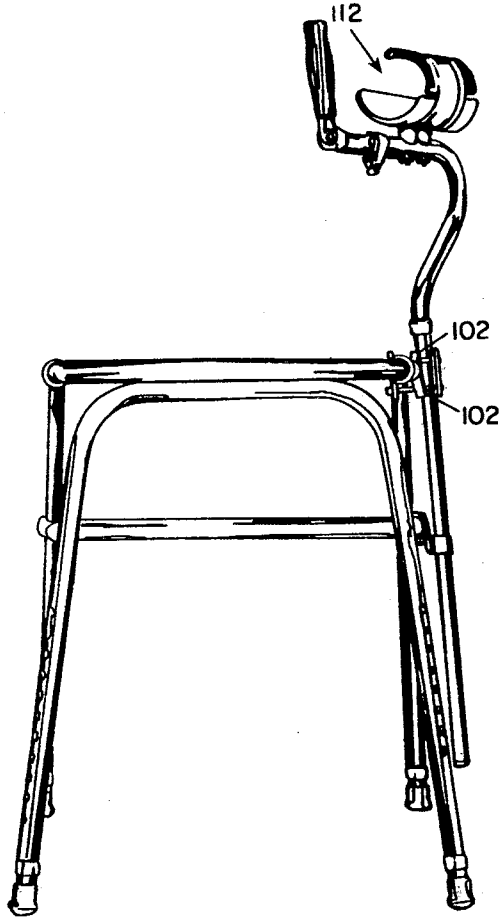
FIG. 2 is a front view of the embodiment of FIG. 1.
Figure 5:
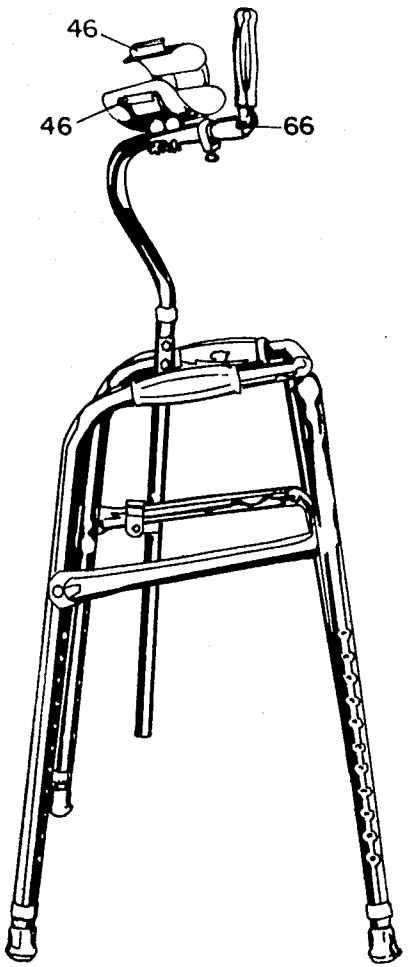
FIG. 5 is a left side view of the embodiment of FIG. 1.
Figure 4:
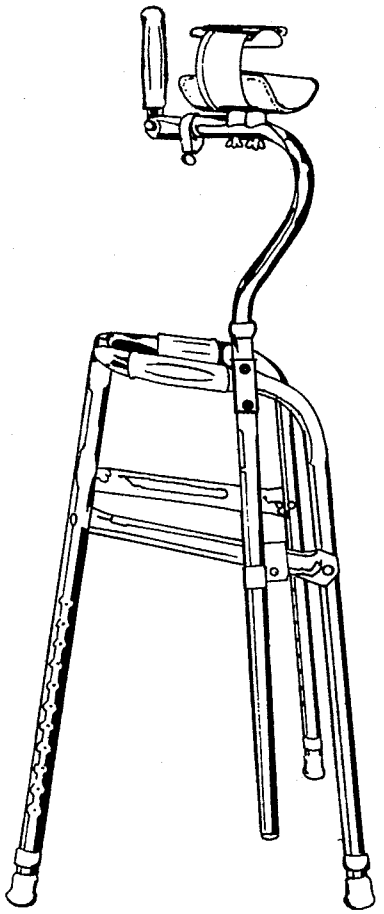
FIG. 4 is a right side view of the embodiment of FIG. 1.
Figure 6:
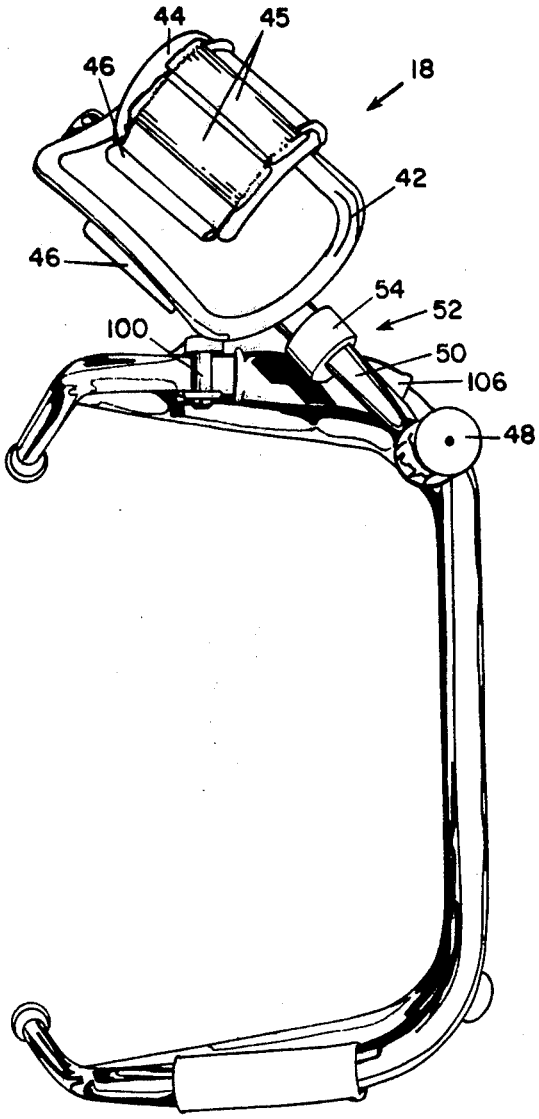
FIG. 6 is a top view of the embodiment of FIG. 1.

The platform crutch attachment 10 according to the preferred embodiment is illustrated on a conventional prior art walker 12 in FIG. 1. FIGS. 2 through 6 illustrate the same embodiment from different angles. The primary elements of the platform crutch 10 include a shaft 14, a handle section 16, cuff 18, upper mounting bracket 20 and lower mounting bracket 22. Shaft 14 has the general shape of a crook and includes a horizontal top section 24, a generally vertical lower or stem section 26 and an intermediate connecting portion 28 between the top section 24 and the lower section 26. Shaft 14 comprises two pieces of tubing which telescope into one another. Specifically, lower section 26 receives an upper piece which comprises the extension of the top section 24 and intermediate section 28. By telescoping section 28 into section 26 it is possible to reinforce the wall of the staff 14 at the location of attachment 20 thereby giving the staff additional rigidity and strength. A plastic collar 32 is located at the top of the lower section 26 and serves to dampen undesirable vibrations. A small plastic cap 30 is located at the bottom end of the lower section 26 to protect the user from the sharp edge of the metal tubing.

Figure 7:
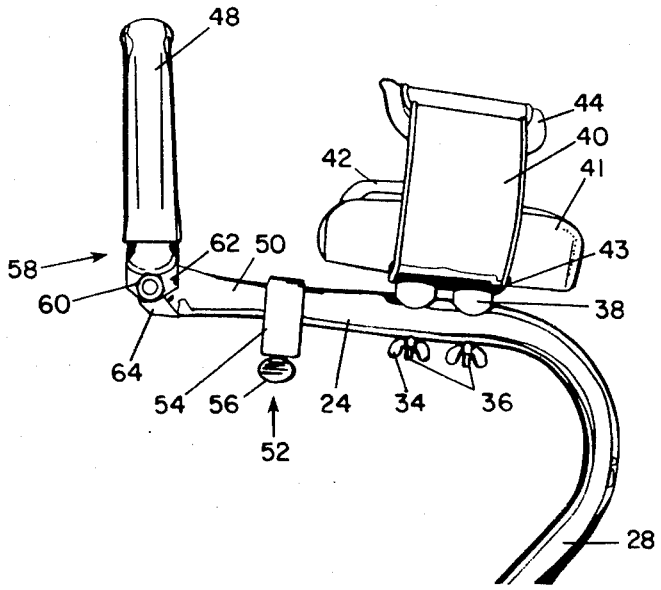
FIG. 7 is a right side detail of the handle and cuff of the preferred embodiment of the invention illustrated in FIG. 1.

Cuff unit 18 is connected to the top section 24 of the staff 14 by a pair of wing nuts 34. Wing nuts 34 are threadably received on studs 36 which pass through two holes in section 24. Studs 36 pass through a pair of plastic stand offs 38 and are connected to metal clip 40. A lower forearm rest pad 42 having a plastic bed 41 is attached to clip 40 by elastic straps 43 near the bottom portion thereof. Similarly, a smaller, upper pad 44 is attached to the top portion of clip 40 opposite from lower pad 42. The lips 46 of clip 40 are curved. Pad 44 has an elastic back strap 45 so that it can be slipped over the upper section of clip 40 or removed if necessary. Clip 40 surrounds the forearm of the user by approximately 300°. It is made of a maleable metal material such that the gap 112 between the upper and lower lips 46 may be adjusted for forearms of different thicknesses. In many prior art apparatus it is necessary to strap the patients forearm into a platform crutch with straps such as those made with Velcro ® fasteners. That presented a distinct disadvantage for several reasons. Firstly, it required more than one person to help a patient into the platform walker. Secondly, if the walker were to fall forward it was not possible for an invalid using prior art straps to disengage his arms from the falling apparatus. With the present apparatus the user can simply pull his arm through the gap 112 between upper and lower lips 46 if the apparatus should tumble forward. Pads 42 and 44 are made of resilient washable materials. Details of the pad construction can be more fully appreciated by referring to FIG. 7.

Figure 14:
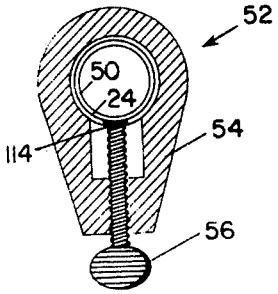
FIG. 14 is a detail cross-sectional view of the handle rotating and locking device 52 shown in FIG. 1.

Handle 16 comprises an upper grip section 48 and a lower tubular section 50 which is received within the hollow top section 24 of staff 14. Sections 48 and 50 rotate as a unit and may be locked in position by locking device 52. According to the preferred embodiment of the invention the locking device 52 comprises a collar 54 which surrounds the top end 24 of the staff 14 and a thumb screw 56 which is threadably received in a hole in collar 54 and which passes through aperture 114 in tubular section 24 so that it can selectively impinge against handle section 50. See FIG. 14 for details. A suitable collar device is described in detail in U.S. Pat. No. 4,085,763 issued to this inventor. Therefore, grip section 48 may be rotated 360° around an axis passing through the top section 24 of the staff 14 and selectively locked at any location. Locking device 52 also allows the distance between the grip 48 and the cuff 18 to be selectively adjusted by moving the tube 50 in and out of tube 24 and locking the tubes together at the desired location. Therefore locking device 52 serves the dual purpose of setting the distance between grip 48 and cuff 18 and setting the angular position of grip 48 around an axis defined by upper section 24.

The tilt of grip 48 is controlled by a second locking device 58. Locking device 58 comprises a bolt 60 which passes through the flattened metal portion 62 of grip section 48 and the flattened end 64 of lower tubular element 50 which is lockable on the other side thereof by hex nut 68. Grip 48 is therefore allowed to rotate around pivot bolt 60 by approximately 300°. Once the appropriate position is found the grip 48 is locked into position by screwing nut 68 into bolt 60. The head of bolt 60 is preferably welded into flat 64 so that the locking operation may be performed by one person. This operation is preferably done by means of a wrench because the force necessary to set the grip 48 in position generally cannot be supplied by a thumbscrew.

The handle arrangement is economical, simple, and extremely effective for individuals having hand deformities, such as advanced cases of arthritis. These diseases may create a condition known as ULNAR DRIFT wherein the wrist is severely bent with respect to the forearm. The present invention according to the preferred embodiment allows users with such a condition to effectively place the grip 48 in a location where it can be readily and securely grasped. Note that the handle arrangement provides for the following three separate positional adjustments:

(a) The distance between the cuff 18 and the handle 48 may be adjusted and locked by locking means 52;

(b) The rotational position of the grip 48 may be selected at any point on a 360° circle and locked at that position by means of locking device 52; and, (c) The forward and backward tilt position of grip 48 may be selected within a range of approximately 300° and locked therein by means of locking device 58.

It should be further noted that the cuff 18 may be removed from upper section 24 and rotated by 180° and re-positioned so that the gap 112 between lips 46 face outwardly. Finally, the distance between pads 42 and 44 may be adjusted by squeezing down on clip 40 to accomodate forearms of different widths.

Figure 10A:
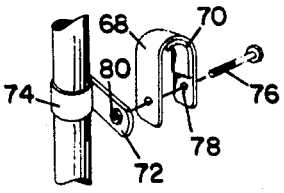
FIG. 10A is an exploded detail view illustrating the manner in which the lower mounting bracket is adapted for use with $\frac{7}{8}''$ diameter brace tubing.
Figure 10B:
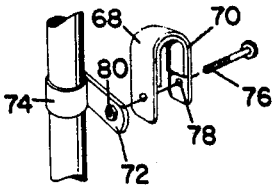
FIG. 10B is an exploded detail view of the lower mounting bracket as adapted for use on $\frac{3}{4}''$ diameter brace tubing.
Figure 11:
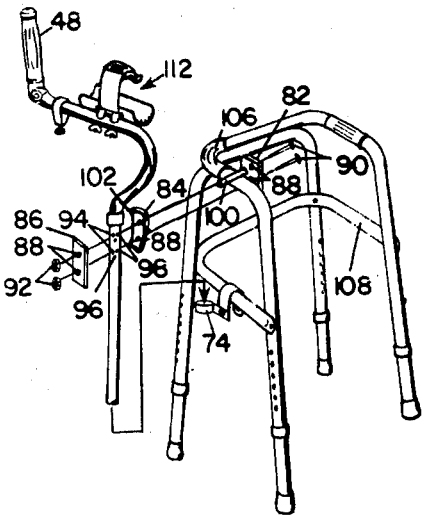
FIG. 11 is an exploded perspective view illustrating the manner in which the crutch attachment is connected to a conventional invalid walker.
Figure 12:
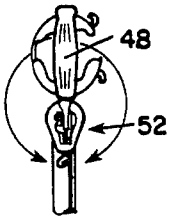
FIG. 12 illustrates the possible angular rotation of the crutch handle.

The platform crutch attachment 10 is connected to the prior art walker 12 by an upper mounting bracket 20 and a lower mounting bracket 22. The lower mounting bracket 22 includes a U-shaped clip 68, a vinyl bushing pad 70, tab section 52 and a shaft engaging ring section 74 attached to tab 72. A bolt 76 then passes through holes 78 in clip 68 and tab 72 and is ultimately fastened to tab 72 by a nut 80 which is threadably received on threads at the end of bolt 76. For convenience and safety the head of bolt 76 may be welded to clip 68. Details of the construction of lower mounting bracket 22 may be more fully understood by referring to FIGS. 10A and 10B and the description that follows later with regard to the assembly of the invention 10.

Upper mounting bracket 20 essentially comprises an inward plate 82, a bite plate 84, and an outward plate 86. Plates 82, 84 and 86 each include a pair of holes 88 which can receive the shaft of a pair of bolts 90. Bolts 90 pass through holes in the shaft 14 and may be locked in position by a pair of locking nuts 92. Shaft 14 includes three pairs of holes 94, 96 and 98 respectively. By passing bolts 90 through shaft holes 94 it is possible to tilt the upper section 24 of shaft 14 inward by approximately 45°. On the other hand, if the opposite set of holes 98 are selected the upper section 24 will point outward by 45°. Alternatively, the middle set of holes 96 may be selected thereby positioning the upper section 24 and the cuff 18 in an intermediate location. This additional range of adjustments makes it possible for individuals having the deformities previously described to use the platform crutch with greater security. A tubular plastic sleeve 100 surrounds top bolt 90 and protect it and the user from each other.

Figure 8:
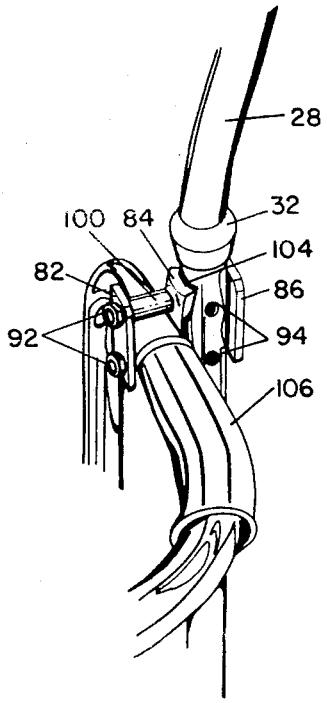
FIG. 8 is a perspective detail view of the upper mounting bracket in position on the upper brace of a conventional walker.

One of the major drawbacks of the prior art is the tendency for the platform supporting staff to rotate within the mounting brackets. The present invention 10 virtually eliminates this problem by the use of a bite plate 84 having curved points or teeth 102 which dig into the lower end 26 of staff 14. Bite plate 84 is roughly rectangular in shape and includes four bite points 102 each respectively located at the corners of the rectangle. Bite plate 84 is curved around its long axis so that the radius of curvature between the bite points 102 at the top and the bite points 102 at the bottom is less than the radius of curvature of lower shaft section 26. Similarly bite plate 84 is bowed along its short axis so that bite plate 84 only contacts shaft 26 at the four points 102 located at its corners. FIG. 8 shows that this results in a small gap 104 between the bite plate 84 and shaft section 26.

The major virtue of bite plate 84 is that it prevents the shaft 14 from rotating by creating an upper and lower moment couple where the points 102 contact shaft 26. If it were not for points 102 there would be a tendency for shaft 14 to rotate. According to the prior art the user might then press down further on the shaft 14 thereby crushing it. The use of the bite plate 84 just described has been most satisfactory in the context of the present invention.

Another feature of the present invention is in the relationship of the cuff 18 to the bottom section 26 of the shaft 14. The cuff 18 is located directly above lower shaft section 26. That is important for several reasons. Firstly, it eliminates astable moments because the weight of the patients forearm is always located on the inward side of the walker 12 and above the mounting brackets 20 and 22. Secondly, this physical arrangement minimizes flexing and working of the tubing thereby increasing the life and strength of the materials.

Another important feature of the invention relates to the fact that the distance between the upper brace 110 of the walker 12 and the cuff 18 always remains the same. That relationship is maintained because the upper mounting bracket 20 is fastened to shaft 14 through a preset pair of holes 94, 96 or 98. According to the prior art, there was a tendency for larger patients to slip the shaft upward in order to accomodate their larger stature. That was found to be dangerous because it increased the tipping potential of the apparatus. The proper way to accomodate the walker for a larger individual is to extend the legs of the walker 12. Because the legs of the walker are tilted outwardly, the base of the walker tends to increase in area as the legs are extended to accomodate a larger patient. Therefore the present invention makes it necessary for a larger patient to extend the legs of the walker according to the preferred method of walker adjustment.

The platform crutch 10 according to the preferred embodiment of the invention is connected to a prior art walker 12 in the following manner which may be more readily understood by referring to FIGS. 9, 10A, 10B, 11 and 12. Initially the hand grip 106 of the prior art walker 12 is slid forward by 1½ to 2". That may be accomplished by wrapping each hand grip in a hot towel or running each hand grip under hot water for 3 to 4 minutes. The hand grips 106 may then be moved by pushing forward on the rear edge with the thumb of each hand. If this is not possible, the hand grip 106 can be sliced lengthwise and removed completely from the walker 12.

Figure 9:
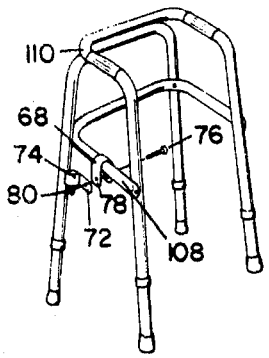
FIG. 9 is a rear perspective view illustrating the attachment of the lower mounting bracket.

Lower mounting bracket 22 is then loosely bolted to the lower side brace 108 of the prior art walker 12 in the manner illustrated in FIG. 9. Because the diameter of the lower side brace 108 can vary from one walker model to another, it may be necessary to insert the vinyl bushing pad 70 into the U-shaped clip 68 before the lower mounting bracket 22 is attached to the lower side brace 108. In general, for 1" diameter tubing no vinyl bushing 70 is required; for ⅞" diameter tubing the vinyl bushing 70 should be cut in half and installed in the manner illustrated in FIG. 10A; and, for ¾" diameter tubing the vinyl bushing pad 70 should be installed in the manner illustrated in FIG. 10B.

The stem section 26 of the platform walker shaft 14 is then slid through ring 74 of lower mounting bracket 22. The platform attachment is loosely bolted to the upper side brace 110 of the walker 12 in the manner illustrated in FIG. 11. The attachment is made by passing bolts 90 through inner plate 82, tubular plastic sleeve 100, bite plate 84, holes 94, 96, or 98, outer plate 86 and engaging the threads on bolts 90 by wing nuts 92. Generally only one tubular plastic sleeve 100 is employed on the top bolt 90. Care should be exercised so that the four pointed tips 102 of bite plate 84 properly dig into shaft section 26. By selecting which pair of holes 94, 96 or 98 through which bolts 90 are to pass, it is possible for the physical therapist to angle the cuff 18 inwardly, straight or outwardly as required by the patients needs.

It is generally recommended that the opening 112 of the cuff 18 face inwardly towards the patient. The opening 112 may be reversed by removing wing nuts 34 and rotating the cuff 18 by 180° and attaching the same. Wing nuts 34 are then replaced and tighten down against studs 36.

The angle of the platform crutch attachment 10 is adjusted by sliding the lower mounting brackets 22 forward or backward along lower side brace 108. In doing so it is preferable to locate the cuff 18 directly above brackets 20 and 22.

The height of the walker 12 may be set as prescribed by the physical therapist. As previously described the distance between cuff 18 and the upper side bracket 10 is always constant, therefore the physical therapist must change the length of the legs of the walker 12 in order to adjust for the height of the patient. The method just described is the preferred manner for adjusting for patients of different stature.

Next, thumbscrew 56 and nut 68 are loosened so that the handle unit 16 is free to assume any desired position. The patient places his forearm in platform cuff 18 so that the rear edge of the cuff pad 42 cuff is no further than 1½" to 2" from the crook of the patients elbow. The position of the hand grip 48 and the distance of the grip 48 from platform cuff 18 is then set so that it matches the most comfortable position of the patients hand. Thumbscrew 56 and nut 68 are then tightened. Finally, all other nuts, wing nuts and thumbscrews are tightened to reasonable tensions.

The platform crutch attachment 10 according to the preferred embodiment has been described and illustrated on the lefthand side of a prior art invalid walker 12. It will be appreciated by those of ordinary skill in the art that the platform crutch attachment 10 may just as easily be connected to the righthand side of an invalid walker 12 in the same manner as described above. The only difference is that on the righthand side it is necessary to reverse cuff 18 by 180° so that the cuff opening 112 faces inward.

Figure 13:
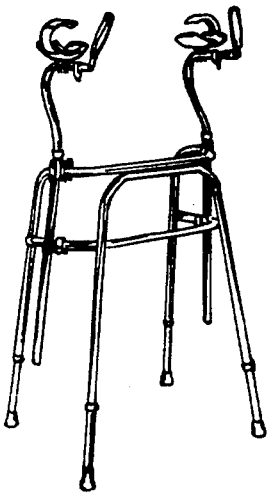
FIG. 13 illustrates the manner in which the platform crutch attachment may be connected to either side of a conventional invalid walker.

Similarly it may be desirable under certain circumstances to have two platform crutch attachments 10 connected to a prior art walker 12. FIG. 13 illustrates a prior art walker 12 with a platform crutch attachment 10 on the right and lefthand side of the device.

The foregoing is a description of the preferred embodiment of a multi-adjustable, stable and safe platform crutch adjustment which includes several unique improvements over the prior art. It will be appreciated by those of ordinary skill in the art that various changes might be made to the structure and function of the parts without departing from the spirit and scope of the invention.

I claim:

1. A crutch attachment apparatus for an invalid walker comprising:

attachment means for connecting said apparatus to said walker;

a shaft connected to said attachment means, said shaft having a top section, a bottom section, and an intermediate connecting section connecting said top and said bottom sections and, a cuff connected to said shaft for supporting a human forearm;

a handle including a grip section attached to the top end of said shaft; and, a handle tilt and locking means for permitting said grip section to be rotated forwardly and backwardly and locking same in a fixed position.

2. The apparatus of claim 1 further including:

a handle rotating and locking means for permitting said handle to rotate sideways and for locking same in a fixed sideways position and for setting the distance between said handle and said cuff.

3. The apparatus of claim 2 where in said cuff includes:

a cuff mounting means for attaching said cuff to said shaft;

a forearm support attached to said mounting means; and, a clip having a gap therein attached to said cuff mounting means for partially surrounding said forearm support, wherein the forearm may be pulled through said gap in said clip if said invalid walker falls forward.

4. The apparatus of claim 3 wherein:

the gap in said cuff clip is eccentrically located with respect to the forearm support of said cuff; and, said mounting means is reversible so that said cuff may be rotated by 180° and remounted.

5. The apparatus of claim 4 wherein said attachment means comprises:

an upper mounting bracket for connecting a first portion of said shaft to an upper brace of said invalid walker; and, a lower mounting bracket for connecting a second portion of said shaft to a lower brace of said invalid walker.

6. The apparatus of claim 5 wherein:

said invalid walker includes a plurality of feet which lie substantially in the same plane and the top section of said shaft lies in a plane substantially parallel to the plane of the base of said invalid walker when said shaft is mounted on said invalid walker.

7. The apparatus of claim 6 wherein said cuff is mounted on the top section of said shaft and said shaft is positioned by said attachment means so that said cuff is located directly above said upper and lower mounting brackets when said shaft is connected to said invalid walker.

8. The apparatus of claim 7 wherein said upper mounting bracket includes a bite plate which makes contact with the bottom end of said shaft at at least two distinct points.

9. The apparatus of claim 8 wherein said shaft comprises two tubular sections telescoped into one another.

10. The apparatus of claim 9 wherein said grip section has one end thereof flattened and said handle includes a lower tubular section one end of which is flattened and the other end of which telescopes into said top section of said shaft and said handle tilt and locking means comprises:

a threaded bolt which passes through the flattened end of said grip section and the flattened end of said lower tubular handle section, said bolt acting as a pivot; and, a nut means received on said threaded bolt which may be manually tightened to lock said handle in a fixed tilted position.

11. The apparatus of claim 10 wherein said handle rotation and locking means comprises:

a collar which surrounds the top section of said shaft, said collar including a threaded aperture therein; and, a threaded screw means received in said aperture and adapted to contact the telescoped portion of said handle through a hole in said top section of said shaft.

12. The apparatus of claim 11 further including:

angular shaft adjustment means for positioning said shaft so that said cuff can be set at at least one of two different positions about an axis defined by the bottom section of said shaft.

13. The apparatus of claim 12 wherein said angular shaft adjustment means comprises at least two pairs of apertures passing through said shaft and which may be selectively employed for use with said upper mounting bracket.

* * * * *